US007665175B2

(12) United States Patent
Jewell

(10) Patent No.: US 7,665,175 B2
(45) Date of Patent: Feb. 23, 2010

(54) ROLLER HOLDER

(75) Inventor: Garland M. Jewell, Hephzibah, GA (US)

(73) Assignee: The Evercare Company, Alpharetta, GA (US)

( * ) Notice: Subject to any disclaimer, the term of this patent is extended or adjusted under 35 U.S.C. 154(b) by 807 days.

(21) Appl. No.: 11/377,012

(22) Filed: Mar. 16, 2006

(65) Prior Publication Data

US 2007/0214589 A1 Sep. 20, 2007

(51) Int. Cl.
*A47L 25/00* (2006.01)
*A47L 25/08* (2006.01)

(52) U.S. Cl. ..... 15/104.002; 492/13

(58) Field of Classification Search ..... 15/104.002, 15/230.11; 492/13, 19
See application file for complete search history.

(56) References Cited

U.S. PATENT DOCUMENTS 4,422,201 A * 12/1983 McKay ..... 15/104.002
6,055,695 A 5/2000 McKay, Jr.
2003/0229958 A1* 12/2003 Thompson et al. ..... 15/104.002
2006/0009337 A1* 1/2006 Smith ..... 492/13

FOREIGN PATENT DOCUMENTS

EP 966915 * 12/1999
EP 1157654 * 11/2001

* cited by examiner

*Primary Examiner*—Mark Spisich
(74) *Attorney, Agent, or Firm*—Gifford, Krass, Sprinkle, Anderson & Citkowski, P.C.

(57) ABSTRACT

A lint roller holder having a pair of elongated housing parts which are substantially identical to each other. Each housing part includes an elongated handle section and semi-cylindrical lint roller support section which is longitudinally adjacent the handle section. The housing parts are secured together in a facing relationship, such that an outer peripheral edge of both of said semi-cylindrical lint roller support and said handle sections abut against each other to form both a cylindrical lint roller support and a handle. The outer peripheral edges of the housing parts are then secured together by ultrasonic welding. Each housing part also includes at least one cut-out in the semi-cylindrical lint roller support section to reduce raw material usage requirements.

14 Claims, 2 Drawing Sheets

ROLLER HOLDER

BACKGROUND OF THE INVENTION

Field of the Invention

The present invention relates generally to a lint roller holder. There are many previously known lint roller holders which rotatably support a tubular cylindrical lint roller. These previously known holders typically include a lint roller support and a longitudinally aligned handle. With a lint roller mounted onto the lint roller support, the handle is used to roll the lint roller along the surface to be cleaned.

One previously known lint roller handle is disclosed in U.S. Pat. No. 6,055,695 to McKay, Jr., which issued on May 2, 2000. In this previously known lint roller holder, the holder included a pair of elongated housing parts. Furthermore, each housing part included both a semi-cylindrical lint roller support section and an elongated handle section longitudinally adjacent to the lint roller support section. When the housing parts are placed together in a facing relationship, the two facing semi-cylindrical lint roller support sections together form a cylindrical lint roller support while the handle sections together form a handle.

In order to secure the housing parts together, this previously known lint roller holder included a plurality of pins and matching recesses molded to the interior of each housing part. Consequently, when the housing parts are positioned together in a facing relationship, the pins on one housing part are received within and secured to the recesses on the other housing part.

These previously known lint roller holder, while effective in operation, were relatively expensive to manufacture and produce for a number of reasons. For example, the necessity of the pins and recesses molded on both of the housing parts in order to attach the housing parts together necessarily required additional raw material for the construction of the handle. Typically, such holders are made of a plastic material and formed by injection molding. Consequently, the raw material consumed by the pins and corresponding recesses increase the overall cost of the plastic material used during the molding process.

A still further disadvantage of these previously known lint roller holders is that the cylindrical lint roller support included a continuous circumferential surface between the longitudinal ends of the lint roller support. This continuous surface was necessary to provide the proper structural support for the pins and recesses to secure the housing parts together. However, the requirement for the continuous lint roller support surface also increased the overall raw material necessary to mold the handle.

BRIEF DESCRIPTION OF THE INVENTION

The present invention provides a lint roller holder which overcomes all of the above-mentioned disadvantages of the previously known devices.

In brief, the lint roller holder of the present invention comprises a pair of elongated housing parts which are substantially identical to each other. Each housing part includes an elongated handle section and a semi-cylindrical lint roller support section longitudinally adjacent the handle section.

The housing parts are secured together in a facing relationship, such that the outer peripheral edge of both the semi-cylindrical lint roller support sections and the handle sections abut against each other to respectively form a cylindrical lint roller support and a handle. These outer peripheral edges are then secured together by an ultrasonic weld.

At least one, and preferably several, cut-outs are formed through the lint roller support section on each housing part. These cut-outs reduce the amount of raw material necessary to form the lint roller holder.

BRIEF DESCRIPTION OF THE DRAWING

A better understanding of the present invention will be had upon reference to the following detailed description when read in conjunction with the accompanying drawing wherein like reference characters refer to like parts throughout the several views, and in which.

DETAILED DESCRIPTION OF A PREFERRED EMBODIMENT OF THE PRESENT INVENTION

Figures 1, 2:
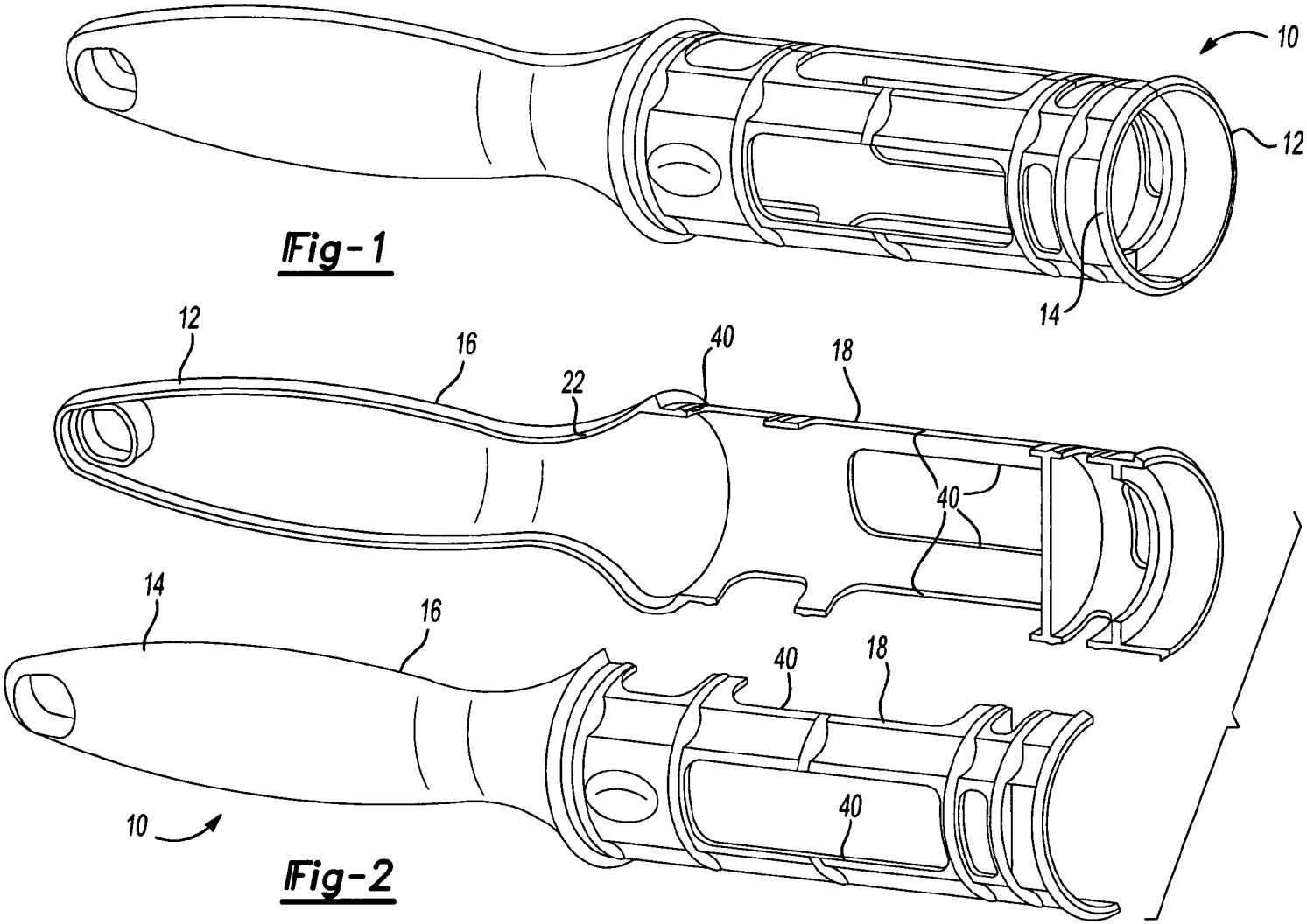
FIG. 1 is an elevational view illustrating a preferred embodiment of the lint roller holder of the present invention.
FIG. 2 is an exploded elevational view of the preferred embodiment of the lint roller holder of the present invention.

With reference first to FIGS. 1 and 2, a preferred embodiment of a lint roller holder 10 of the present invention is shown. The lint roller holder 10 includes two elongated housing parts 12 and 14 which are preferably substantially identical to each other. Each housing part 12 and 14 includes an elongated handle section 16 and a semi-cylindrical lint roller support section 18 longitudinally adjacent to the handle section 16. Each housing part 12 and 14, furthermore, is preferably formed from plastic by injection molding.

Still referring to FIGS. 1 and 2, in order to form the lint roller holder 10, the housing parts 12 and 14 are positioned together in a facing relationship as shown in FIG. 1. In doing so, an outer peripheral edge 22 on one housing part 12 abuts against the outer peripheral edge 22 on the other housing part 14.

Figure 3:
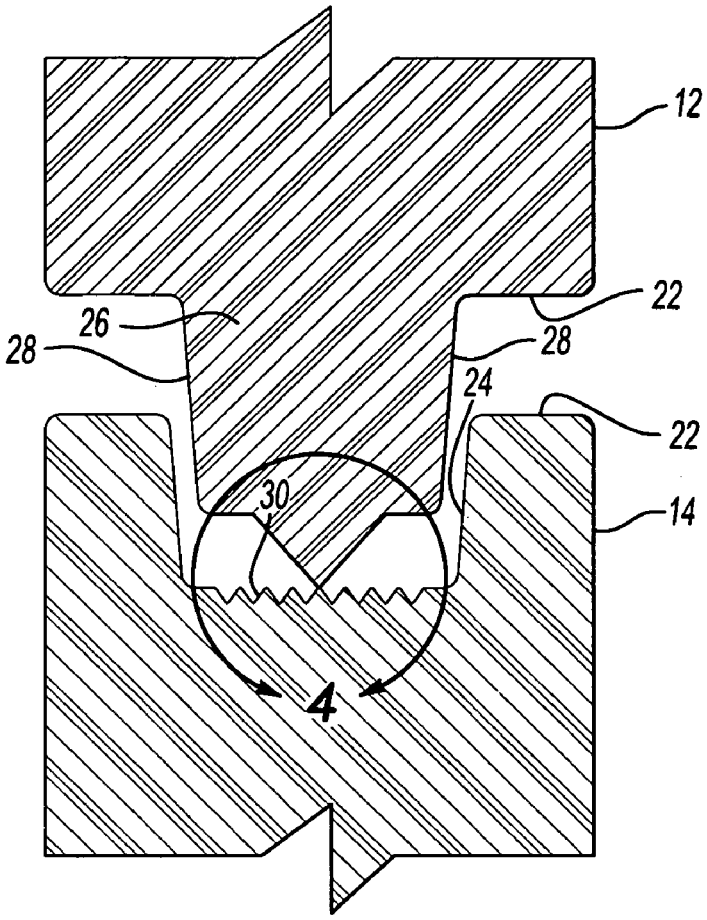
FIG. 3 is a fragmentary sectional view illustrating a portion of the outer peripheral edge of each housing part of the lint roller holder.
Figure 4:
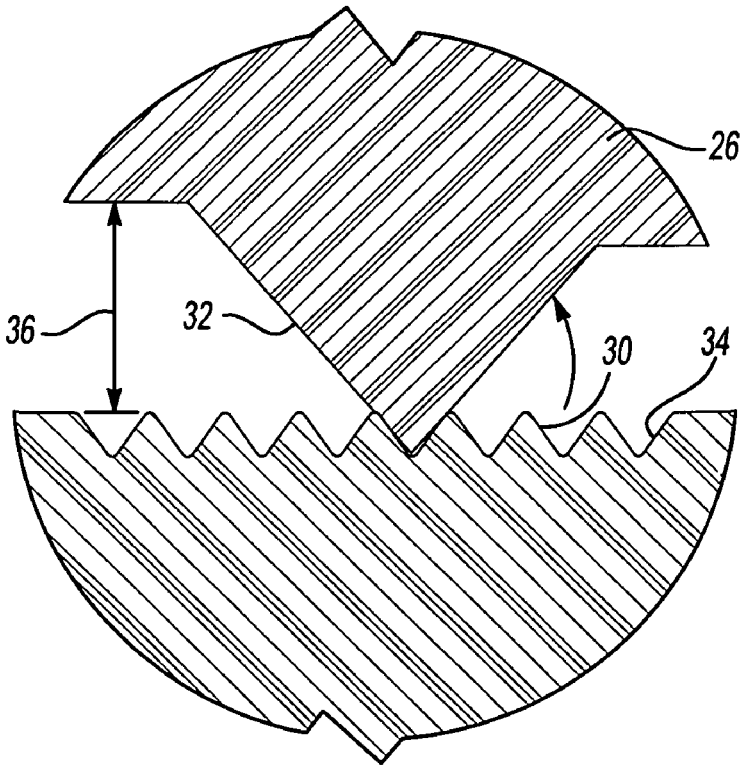
FIG. 4 is a view taken along lines 4-4 in FIG. 3 and enlarged for clarity.

With reference now to FIGS. 3 and 4, the configuration of the outer peripheral edge 22 is shown in greater detail. More specifically, a channel 24 is formed along substantially one-half of the outer peripheral edge 22 of each housing part 12 and 14. In addition, an outwardly protruding ridge 26 is formed along the remaining portion of each outer peripheral edge 22 of the housing parts 12 and 14. Furthermore, the outwardly protruding ridge 26 and channel 24 are formed along the outer peripheral edge 22 of the housing parts 12 and 14 so that, when the housing parts 12 and 14 are placed together in a facing relationship as shown in FIG. 1, the portions of the outer peripheral edge 22 contain the ridge 26 on one housing part 12 are aligned with the portion containing the channel 24 on the outer peripheral edge 22 of the other housing part 14.

Still referring to FIGS. 3 and 4, the ridge 26 is dimensioned to fit within the channel 24 as best shown in FIG. 3. Furthermore, the sides 28 of the ridge 26 taper inwardly which not only facilitates the molding process for the housing parts 12 and 14, but also facilitates the nesting of the ridge 26 within the channel 24 during assembly of the housing parts 12 and 14 together.

A bottom surface 30 of the channel 24 is preferably textured. In addition, an outwardly protruding peak 32 on the ridge 26 abuts against the textured surface 30 and preferably nests within a recess 34 on the textured surface 30. The cooperation between the peak 32 and the textured surface 30 increases the surface contact between the housing parts 12 and 14 when they are positioned together in a facing relationship.

In order to secure the housing parts 12 and 14 together in a facing relationship, the outer peripheral edges 22 of the housing parts 12 and 14 are ultrasonically welded together after the housing parts are positioned together in a facing relationship. During this ultrasonic welding operation, the nesting of the peak 32 within the recess 34 of the textured surface 30 increases the surface-to-surface contact between the housing parts and thus, facilitates the ultrasonic welding operation.

In practice, the channels 24 and ridges 26 along the outer peripheral edges of the housing parts 12 and 14 are relatively small. For example, the depth of the channel 24 is preferably approximately 0.03 inches, while the height of 36 of the peak 32 is approximately 0.01 inches. However, even with such small dimensions for both the ridge 26 and channel 24 the contact between the housing parts 12 and 14 is sufficient to ensure a firm locking between the ridge 26 and channel 24, as well as a firm attachment after the ultrasonic welding operation.

With reference again to FIGS. 1 and 2, at least one, and preferably several, cuts-outs 40 are formed through each housing part 12 and 14. Preferably, at least one, and preferably two, of the cut-outs 40 extend to the outer peripheral edge 22 on each housing part 12 and 14. These cut-outs 40 serve to reduce the raw material required in forming the lint roller holder without sacrificing the quality or operation of the lint roller holder.

Having described my invention, it can be seen that the present invention provides a novel lint roller holder which is not only inexpensive to manufacture, but also of a high quality construction.

Having described my invention, however, many modifications thereto will become apparent to those of skill in the art to which it pertains without deviation from the spirit of the invention, as defined by the scope of the appended claims.

I claim:

1. A lint roller holder comprising a pair of elongated housing parts, each housing part having an elongated handle section and a semi-cylindrical lint roller support section longitudinally adjacent the handle section, means for securing said housing parts together in facing relationship such that an outer peripheral edge of both said semi-cylindrical lint roller support sections and said handle sections abut against each other to form both a cylindrical lint roller support and a handle, said securing means comprising an ultrasonic weld along the abutting outer peripheral edges of the housing parts, wherein a channel is formed along substantially one half of the peripheral edge of each housing part and a ridge is formed along the remainder of the peripheral edge of each housing part, said ridge on one housing part dimensioned to nest within said channel of the other housing part when said housing parts are positioned together in said facing relationship, and wherein said ultrasonic weld extends between said ridge and said channel.

2. The invention as defined in claim 1 wherein each housing part is substantially identical to the other.

3. The invention as defined in claim 1 wherein said channel includes a textured surface and wherein said ridge includes an outwardly protruding peak which abuts against said textured surface.

4. The invention as defined in claim 1 wherein said ridge includes inwardly sloping sides to thereby form a clearance between said ridge and said channel.

5. The invention as defined in claim 1 wherein each lint roller support section on each housing part includes at least one cut-out.

6. The invention as defined in claim 5 wherein said at least one cut-out extends to said outer peripheral edge.

7. The invention as defined in claim 1 wherein each lint roller support section on each housing part includes at least three cut-outs, two of said cut-outs extending to said outer peripheral edge.

8. A lint roller holder comprising a pair of elongated housing parts, each housing part having an elongated handle section and a semi-cylindrical lint roller support section longitudinally adjacent the handle section, said housing parts being positioned together in facing relationship such that an outer peripheral edge of both said semi-cylindrical lint roller support sections and said handle sections abut against each other to form both a cylindrical lint roller support and a handle, said housing parts being secured by an ultrasonic weld along the abutting outer peripheral edges of the housing parts, wherein a channel is formed along substantially one half of the peripheral edge of each housing part and a ridge is formed along the remainder of the peripheral edge of each housing part, said ridge on one housing part dimensioned to nest within said channel of the other housing part when said housing parts are positioned together in said facing relationship, and wherein said ultrasonic weld extends between said ridge and said channel.

9. The invention as defined in claim 8 wherein each housing part is substantially identical to the other.

10. The invention as defined in claim 8 wherein said channel includes a textured surface and wherein said ridge includes an outwardly protruding peak which abuts against said textured surface.

11. The invention as defined in claim 8 wherein said ridge includes inwardly sloping sides to thereby form a clearance between said ridge and said channel.

12. The invention as defined in claim 8 wherein each lint roller support section on each housing part includes at least one cut-out.

13. The invention as defined in claim 12 wherein said at least one eat-out extends to said outer peripheral edge.

14. The invention as defined in claim 8 wherein each lint roller support section on each housing part includes at least three cut-outs, two of said cut-outs extending to said outer peripheral edge.

* * * * *

UNITED STATES PATENT AND TRADEMARK OFFICE

CERTIFICATE OF CORRECTION

PATENT NO. : 7,665,175 B2
APPLICATION NO. : 11/377012
DATED : February 23, 2010
INVENTOR(S) : Garland M. Jewell It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1014 days.

Signed and Sealed this

Seventh Day of December, 2010

David J. Kappos

David J. Kappos
*Director of the United States Patent and Trademark Office*